US010249141B2

(12) United States Patent
Penacho et al.

(10) Patent No.: US 10,249,141 B2
(45) Date of Patent: Apr. 2, 2019

(54) METHOD OF GAMING, A GAMING SYSTEM AND A GAME CONTROLLER

(71) Applicant: Aristocrat Technologies Australia Pty Limited, North Ryde (AU)

(72) Inventors: Gary Joseph Penacho, Henderson, NV (US); Casey Lyle Condron, Las Vegas, NV (US); Thomas Tuomey, Las Vegas, NV (US); Kurt Larsen, Las Vegas, NV (US); Charles Schotborgh, Las Vegas, NV (US); Adam Pippin, Las Vegas, NV (US); Ryan Shawn Carr, Las Vegas, NV (US)

(73) Assignee: Aristocrat Technologies Australia Pty Limited (AU)

( * ) Notice: Subject to any disclaimer, the term of this patent is extended or adjusted under 35 U.S.C. 154(b) by 59 days.

(21) Appl. No.: 14/869,341

(22) Filed: Sep. 29, 2015

(65) Prior Publication Data

US 2016/0189471 A1 Jun. 30, 2016

(30) Foreign Application Priority Data

Sep. 29, 2014 (AU) ..... 2014903915

(51) Int. Cl.
*G07F 17/32* (2006.01)
*G07F 17/34* (2006.01)

(52) U.S. Cl.
CPC ..... *G07F 17/326* (2013.01); *G07F 17/34* (2013.01)

(58) Field of Classification Search
None
See application file for complete search history.

(56) References Cited

U.S. PATENT DOCUMENTS

2003/0022712 A1* 1/2003 Locke ..... G07F 17/3211 463/20
2004/0033829 A1* 2/2004 Pacey ..... G07F 17/3265 463/20
2008/0227541 A1* 9/2008 Berman ..... G07F 17/32 463/31
2012/0094753 A1* 4/2012 Petri ..... G07F 17/326 463/30
2014/0357368 A1* 12/2014 Taylor ..... A63F 13/54 463/35
2015/0080093 A1* 3/2015 Caputo ..... G07F 17/326 463/20
2015/0302687 A1* 10/2015 Fujita ..... G07F 17/3213 463/20

* cited by examiner

*Primary Examiner* — Robert T Clarke, Jr.
(74) *Attorney, Agent, or Firm* — McAndrews, Held & Malloy, Ltd.

(57) ABSTRACT

The present invention relates to a gaming machine, methods of gaming and gaming systems. The gaming system comprises: a first video display; a second video display; and a game controller. The game controller is arranged to: select a plurality of symbols from a symbol set for display on the first video display and the second video display; and evaluate a symbol subset comprising one or more of the plurality of symbols to determine whether to make an award. The number of symbols of the symbol subset is higher than a number of symbols in the symbol subset evaluated by the game controller in a previous game instance.

25 Claims, 8 Drawing Sheets

METHOD OF GAMING, A GAMING SYSTEM AND A GAME CONTROLLER

RELATED APPLICATIONS

This application claims priority to Australian Provisional Patent Application No. 2014903915, having a filing date of Sep. 29, 2014, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

In electronic gaming systems such as spinning reel or "slot" gaming machines, symbols are selected for display on a display of the machine. The displayed symbols are evaluated to determine whether an award is to be made to a player.

While such gaming systems provide players with enjoyment, a need exists for alternative gaming systems in order to maintain or increase player enjoyment.

BRIEF SUMMARY OF THE INVENTION

In accordance with a first aspect, the present invention provides an electronic gaming system comprising:

a first video display;

a second video display; and a game controller arranged to:

select a plurality of symbols from a symbol set for display on the first video display and the second video display; and evaluate a symbol subset comprising one or more of the plurality of symbols to determine whether to make an award, wherein a number of symbols of the symbol subset is higher than a number of symbols in the symbol subset evaluated by the game controller in a previous game instance.

In an embodiment, during the first game instance the one or more of the plurality of symbols of the symbol subset are displayed in respective symbol display positions arranged on the first video display. During the last game instance the symbol subset may comprise all the symbols of the plurality of symbols.

In accordance with a second aspect, the present invention provides an electronic gaming system comprising:

a first video display;

a second video display; and a game controller arranged to:

select a plurality of symbols from a symbol set for display on the first video display and the second video display; and evaluate a symbol display position subset comprising one or more of the plurality of symbol display positions to determine whether to make an award;

wherein a number of symbol display positions of the symbol display position subset is higher than a number of symbol display positions in the symbol display position subset evaluated by the game controller in a previous game instance.

In an embodiment, during the first game instance the one or more of the plurality of symbol display positions of the symbol display position subset are arranged on the first video display. During the last game instance the symbol display position subset may comprise all the symbol display positions of the plurality of symbol display positions.

In an embodiment, the second video display is positioned above the first video display. The first and the second video displays may be arranged to display a single gaming area. Each of the first and second video display may comprise a plurality of symbol display positions arranged in five columns.

In an embodiment, the plurality of symbols comprise a movable symbol and the game controller is arranged to move the movable symbol from a first symbol display position to a second symbol display position.

In an embodiment, the first symbol display position is located below the second symbol display position.

In an embodiment, upon moving of the movable symbol from the first symbol display position to the second symbol display position, the movable symbol replaces one or more symbols positioned at the second symbol display position.

In an embodiment, the movable symbol is associated with an animated object.

In an embodiment, the movable symbol is a wild symbol.

In an embodiment, the game controller is further arranged to increase a multiplier. The multiplier may be increased upon moving of the movable symbol.

In accordance with a third aspect, the present invention provides an electronic gaming system comprising:

at least one video display; and a game controller arranged to:

select a plurality of symbols from a symbol set for display on the at least one video display; and evaluate a symbol subset comprising one or more of the plurality of symbols to determine whether to make an award;

the plurality of symbols comprising a movable symbol and the game controller being arranged to:

move the movable symbol from a first symbol display position to a second symbol display position located above the first symbol display position;

wherein a number of symbols of the symbol subset is higher than a number of symbols in the symbol subset evaluated by the game controller in a previous game instance.

In an embodiment, the gaming system comprises a first video display and a second video display positioned above the first video display.

In an embodiment, the movable symbol is a wild symbol.

In accordance with a fourth aspect, the present invention provides an electronic game controller, the game controller arranged to:

select a plurality of symbols from a symbol set for display on a first video display and a second video display, and evaluate a symbol subset comprising one or more of the plurality of symbols to determine whether to make an award;

wherein a number of symbols of the symbol subset is higher than a number of symbols in the symbol subset evaluated by the game controller in a previous game instance.

In an embodiment, during the first game instance, the game controller is arranged to control the first video display and the second video display to display the plurality of symbols of the symbol subset in respective symbol display positions arranged on the first video display. The game controller may be further arranged to control the first and the second video displays to display a single gaming area. The game controller may be further arranged to control the first and the second video displays to display a plurality of symbol display positions arranged in five columns.

In an embodiment, the plurality of symbols comprise a movable symbol and the game controller is arranged to move the movable symbol from a first symbol display position to a second symbol display position.

In an embodiment, the game controller is arranged in a manner such that, upon moving of the movable symbol from the first symbol display position to the second symbol display position, the movable symbol replaces one or more symbols positioned at the second symbol display position.

In an embodiment, the game controller is arranged to control the first and the second display to display an animation upon moving of the movable symbol.

In an embodiment, the game controller is further arranged to increase a multiplier upon moving of the movable symbol.

In an embodiment, the movable symbol is a wild symbol.

In accordance with a fifth aspect, the present invention provides an electronic gaming system comprising:

a first video display;

a second video display; and a symbol selector arranged to select a plurality of symbols from a symbol set for display on the first video display and the second video display; and an outcome evaluator arranged to evaluate a symbol subset comprising one or more of the plurality of symbols to determine whether to make an award;

wherein a number of symbols of the symbol subset is higher than a number of symbols in the symbol subset evaluated by the outcome evaluator in a previous game instance.

In an embodiment, during the first game instance the one or more of the plurality of symbols of the symbol subset are displayed in respective symbol display positions arranged on the first video display. During the last game instance the symbol subset may comprise all the symbols of the plurality of symbols.

In an embodiment, the second video display is positioned above the first video display.

In an embodiment, the plurality of symbols comprise a movable symbol and the gaming system further comprises a symbol mover arranged to move the movable symbol from a first symbol display position to a second symbol display position.

In an embodiment, the movable symbol is a wild symbol.

In an embodiment, the gaming system further comprises a multiplier controller arranged to increase a multiplier.

In accordance with a sixth aspect, the present invention comprises an electronic method of gaming, comprising a game controller:

selecting a plurality of symbols from a symbol set for display on a first video display and a second video display, and evaluating a symbol subset comprising one or more of the plurality of symbols to determine whether to make an award;

wherein a number of symbols of the symbol subset is higher than a number of symbols in the symbol subset evaluated by the game controller in a previous game instance.

In an embodiment, the plurality of symbols comprise a movable symbol and the game controller moves the movable symbol from a first symbol display position to a second symbol display position.

In an embodiment, the game controller is further arranged to increase a multiplier.

In accordance with a seventh aspect, the present invention provides an electronic gaming system comprising:

a first video display means;

a second video display means; and means for selecting a plurality of symbols from a symbol set for display on the first video display and the second video display;

means for evaluating a symbol subset comprising one or more of the plurality of symbols to determine whether to make an award;

wherein a number of symbols of the symbol subset is higher than a number of symbols in the symbol subset evaluated by the means for evaluating the symbol subset in a previous game instance.

In accordance with an eighth seventh aspect, the present invention provides computer program code which when executed by a processor causes the processor to:

select a plurality of symbols from a symbol set for display on a first video display and a second video display, and evaluate a symbol subset comprising one or more of the plurality of symbols to determine whether to make an award;

wherein a number of symbols of the symbol subset is higher than a number of symbols in the symbol subset evaluated by the processor in a previous game instance.

In accordance with a ninth aspect, the present invention provides a tangible computer readable medium comprising the computer program code in accordance with the eighth aspect.

In accordance with a tenth aspect, the present invention provides a distributed electronic gaming system comprising:

a gaming server suitable for communicating with one or more client devices over a communication network;

the gaming server comprising a game controller arranged to select a plurality of symbols from a symbol set for display on a first video display area and a second video display area of the one or more client devices and, evaluate a symbol subset comprising one or more of the plurality of symbols to determine whether to make an award;

wherein a number of symbols of the symbol subset is higher than a number of symbols in the symbol subset evaluated by the game controller in a previous game instance.

In an embodiment, during the first game instance the one or more of the plurality of symbols of the symbol subset are displayed in respective symbol display positions arranged on the first video display area of the one or more client devices.

In an embodiment, the plurality of symbols comprise a movable symbol and the game controller is arranged to move the movable symbol from a first symbol display position to a second symbol display position.

In an embodiment, the movable symbol is a wild symbol.

In an embodiment, the game controller is further arranged to increase a multiplier.

In accordance with yet another aspect, the present invention provides an electronic game controller. The game controller may select a plurality of symbols from a symbol set for display on a first video display and a second video display, and evaluate a symbol subset comprising one or more of the plurality of symbols to determine whether to make an award. A number of symbols of the symbol subset is higher than a number of symbols in the symbol subset evaluated by the game controller in a previous game instance.

During a first game instance, the game controller may control the first video display and the second video display to display the plurality of symbols of the symbol subset in respective symbol display positions arranged on the first video display.

The game controller may further control the first and the second video displays to display a single gaming area.

The game controller may further control the first and the second video displays to display a plurality of symbol display positions arranged in five columns.

The plurality of symbols may comprise a movable symbol and the game controller moves the movable symbol from a first symbol display position to a second symbol display position.

The game controller may be arranged in a manner such that, upon moving of the movable symbol from the first symbol display position to the second symbol display position, the movable symbol replaces one or more symbols positioned at the second symbol display position.

The game controller may control the first and the second video display to display an animation upon moving of the movable symbol.

The movable symbol may be a wild symbol.

The game controller may increase a multiplier.

The multiplier may be increased upon moving of the movable symbol.

In accordance with still another aspect, the present invention provides an electronic gaming system comprising: a first video display; a second video display; and a symbol selector to select a plurality of symbols from a symbol set for display on the first video display and the second video display; and an outcome evaluator to evaluate a symbol subset comprising one or more of the plurality of symbols to determine whether to make an award. A number of symbols of the symbol subset is higher than a number of symbols in the symbol subset evaluated by the outcome evaluator in a previous game instance.

During a first game instance, the one or more of the plurality of symbols of the symbol subset are displayed in respective symbol display positions arranged on the first video display.

During a last game instance, the symbol subset comprises all the symbols of the plurality of symbols.

The second video display may be positioned above the first video display.

The plurality of symbols may comprise a movable symbol. The gaming system may further comprise a symbol mover to move the movable symbol from a first symbol display position to a second symbol display position.

The movable symbol may be a wild symbol.

The gaming system may further comprise a multiplier controller to increase a multiplier.

In accordance with still another aspect, the present invention provides an electronic method of gaming, comprising a game controller. The method includes selecting a plurality of symbols from a symbol set for display on a first video display and a second video display, and evaluating a symbol subset comprising one or more of the plurality of symbols to determine whether to make an award. A number of symbols of the symbol subset is higher than a number of symbols in the symbol subset evaluated by the game controller in a previous game instance.

The plurality of symbols may comprise a movable symbol. The game controller may move the movable symbol from a first symbol display position to a second symbol display position.

The game controller may increase a multiplier.

In accordance with still another aspect, the present invention provides an electronic gaming system comprising: a first video display means;

a second video display means; and means for selecting a plurality of symbols from a symbol set for display on the first video display and the second video display; means for evaluating a symbol subset comprising one or more of the plurality of symbols to determine whether to make an award; wherein a number of symbols of the symbol subset is higher than a number of symbols in the symbol subset evaluated by the means for evaluating the symbol subset in a previous game instance.

In accordance with still another aspect, the present invention provides a computer program code which when executed by a processor causes the processor to select a plurality of symbols from a symbol set for display on a first video display and a second video display, and evaluate a symbol subset comprising one or more of the plurality of symbols to determine whether to make an award. A number of symbols of the symbol subset is higher than a number of symbols in the symbol subset evaluated by the processor in a previous game instance.

A tangible computer readable medium may comprise the computer program code.

In accordance with still another aspect, the present invention provides a distributed electronic gaming system comprising: a gaming server suitable for communicating with one or more client devices over a communication network, the gaming server comprising a game controller arranged to select a plurality of symbols from a symbol set for display on a first video display area and a second video display area of the one or more client devices and, evaluate a symbol subset comprising one or more of the plurality of symbols to determine whether to make an award; wherein a number of symbols of the symbol subset is higher than a number of symbols in the symbol subset evaluated by the game controller in a previous game instance.

During a first game instance, the one or more of the plurality of symbols of the symbol subset may be displayed in respective symbol display positions arranged on the first video display area of the one or more client devices.

The plurality of symbols may comprise a movable symbol and the game controller may move the movable symbol from a first symbol display position to a second symbol display position.

The movable symbol may be a wild symbol.

The game controller may increase a multiplier.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
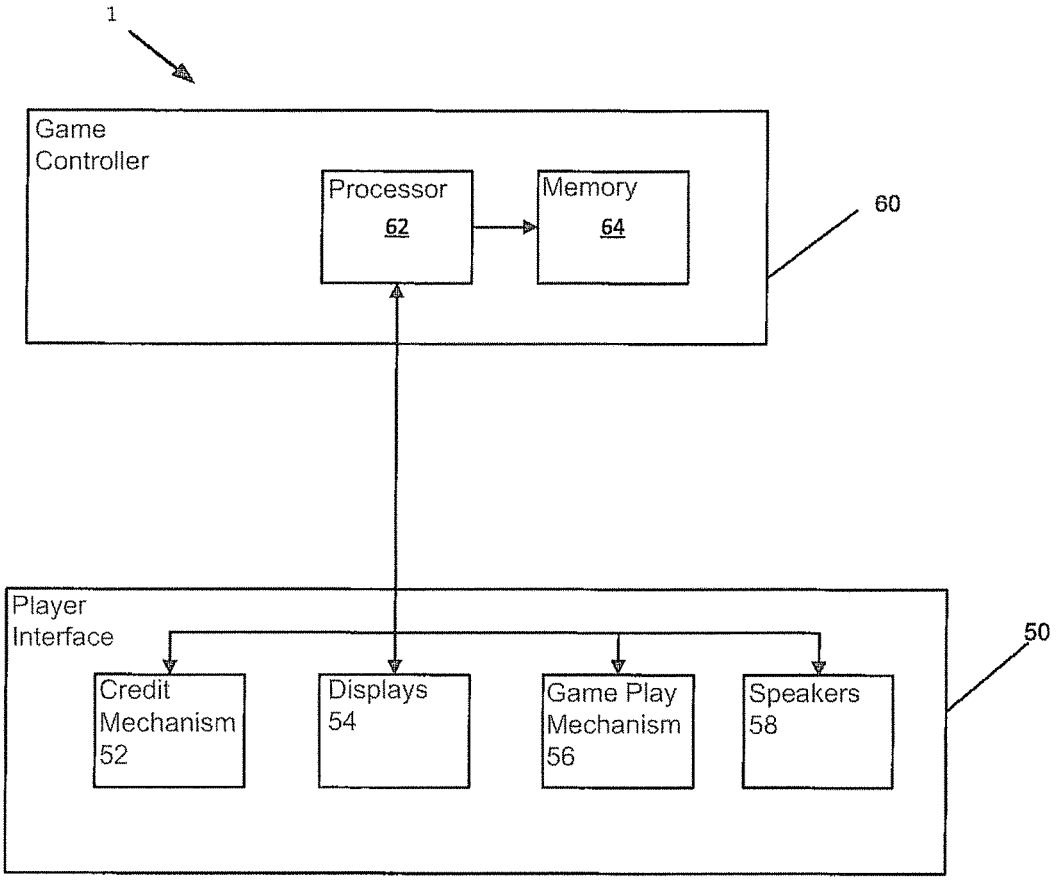
FIG. 1 is a block diagram of the core components of a gaming system.

Referring to the drawings, there is shown an embodiment of an electronic gaming system with two video displays which display a gaming area. The gaming system has a game controller that controls several elements of the system to implement instances of a game. The game controller selects a plurality of symbols from a symbol set and displays the symbols on the two video displays at respective symbol display positions. For each game instance, the controller evaluates a symbol subset to determine whether to make an award. If the controller determines that an award has to be made based on the symbols of the symbol subset, the determined award is issued to the player. The symbol subset comprises one or more of the plurality of symbols on the two screens. The number of symbols in the symbol subset is variable and increases for each game instance. During a game, instance after instance, the number of symbols evaluated by the game controller to determine whether an award has to be made increases and so the number of winning lines which can generate an award.

In embodiments, the two video displays are positioned one on top of the other. During the first instance of the game the one or more symbols of the symbol subset are positioned on the bottom video display. The top video display may also have symbol display positions occupied by symbols but, during the first instance, the symbols of the top video display are not part of the symbol subset and do not contribute to determining whether an award has to be made. During the last instance of the game, all the symbols displayed in the top video display are part of the symbol subset and do contribute to determining whether an award has to be made.

In some embodiments, during the first instance the one or more symbols of the symbol subset are positioned in symbol display positions on the bottom video display and the top video display may not show any symbol display positions occupied by symbols. The total number of symbol display positions increases throughout the game and a portion of the symbol display positions are displayed on the top video display.

In some embodiments, there is a movable symbol occupying one or more symbol display positions and the game controller, moves the movable symbol upwards, from a first symbol display position to a second symbol display position. The movable symbol typically replaces the symbols displayed at the second display position.

In some embodiments, when the movable symbol is being moved, an animation is shown on one or both of the two video displays. The movable symbol may be an animated symbol and may also be a wild symbol. The game controller increases a multiplier upon moving of the movable symbol.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system 1 has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
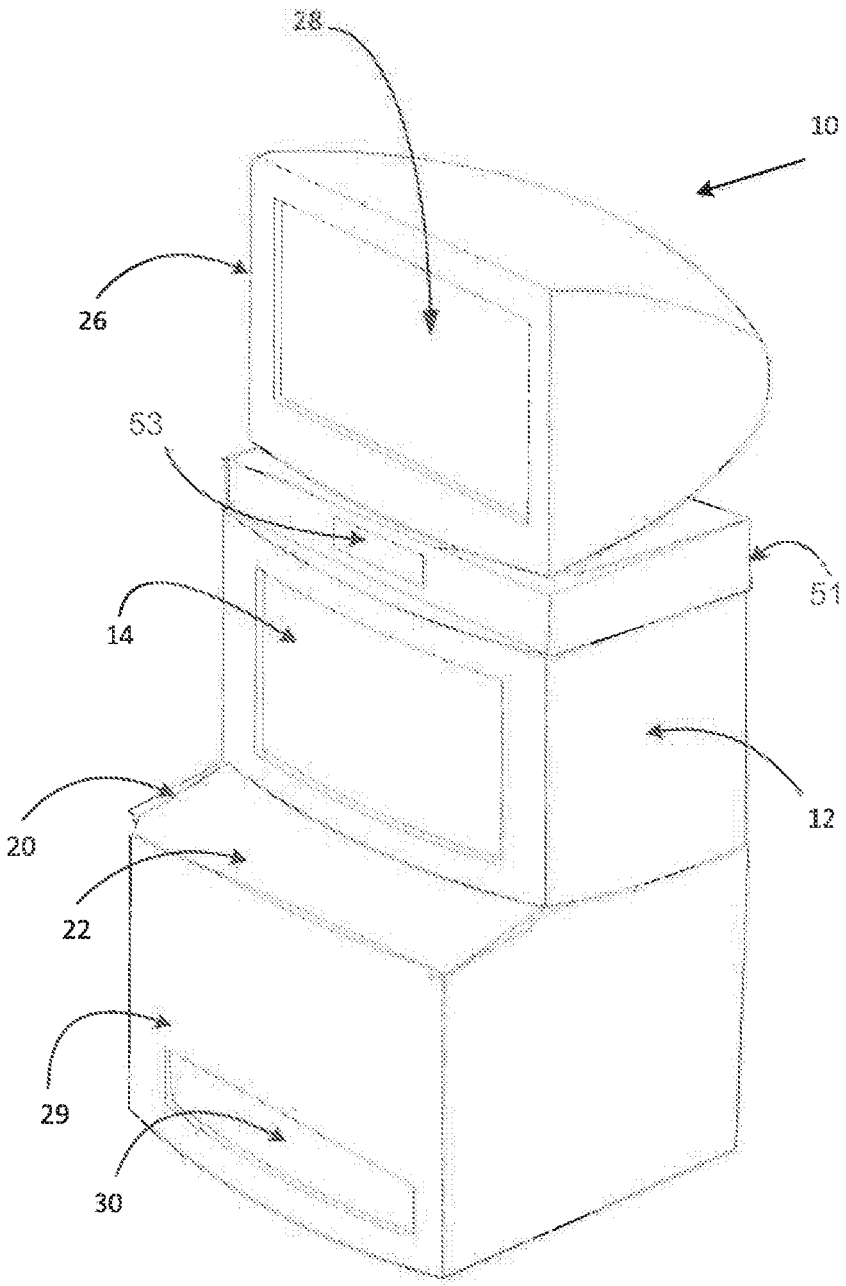
FIG. 2 is a perspective view of a stand alone gaming machine.

A gaming system in the form of a standalone gaming machine 10 is illustrated in FIG. 2. The gaming machine 10 includes a console 12 having a first video display 14. A mid-trim 20 of the gaming machine 10 houses a bank of buttons 22 for enabling a player to interact with the gaming machine, in particular during game play. The video display 14 may also have a touch screen to enable the user to input instructions. The video display 14 shown in FIG. 2 is in the form of a video display unit, particularly a cathode ray tube device. Alternatively, the display 14 may be a liquid crystal display, plasma screen, any other suitable video display unit. The top box 26 has a secondary video which may be of the same type as the display 14, or of a different type.

While not shown in FIG. 2, the mid-trim 20 also typically houses a credit input mechanism such as a coin input chute and a bill collector. FIG. 2 also shows the credit input mechanism in the form of a player marketing module 51 having a reading device 53 for the purpose of reading a player tracking device, for example as part of a loyalty program. The player tracking device may be in the form of a card, flash drive or any other portable storage medium capable of being read by the reading device. The player marketing module 51 also allows the player to transferring credits to the gaming machine from credits stored on the player tracking device or by transferring credits from a player account in data communication with the player marketing module. Other embodiments of gaming machines may have a ticket reader for reading tickets having a value and crediting the player based on the face value of the ticket.

Artwork and/or information may be provided on a front panel 29 of the console 12. A coin tray 30 is mounted beneath the front panel 29 for dispensing cash payouts from the gaming machine 10.

Figure 3:
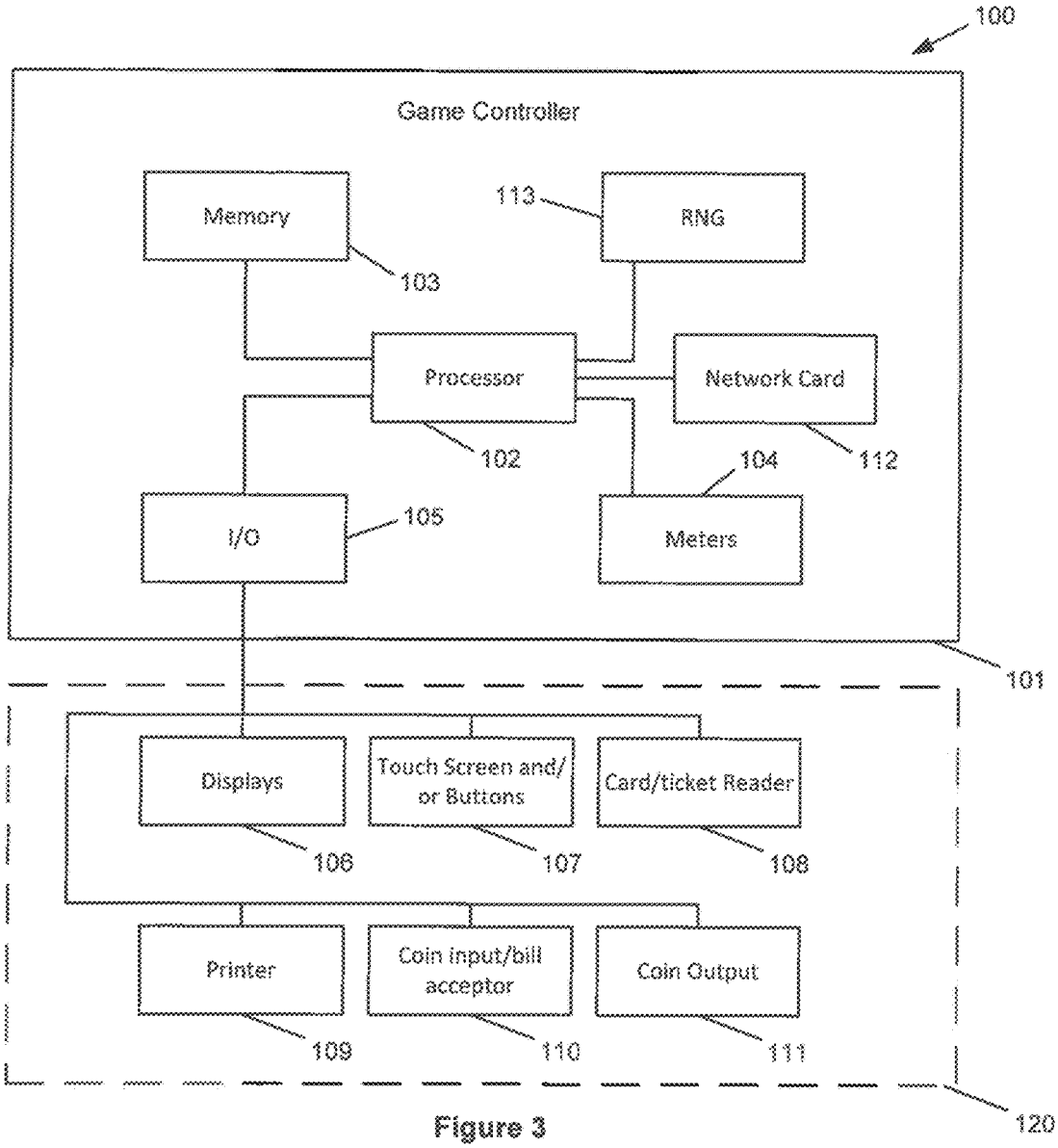
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
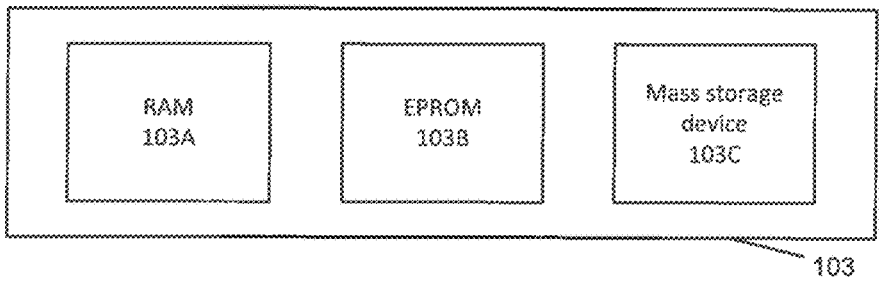
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
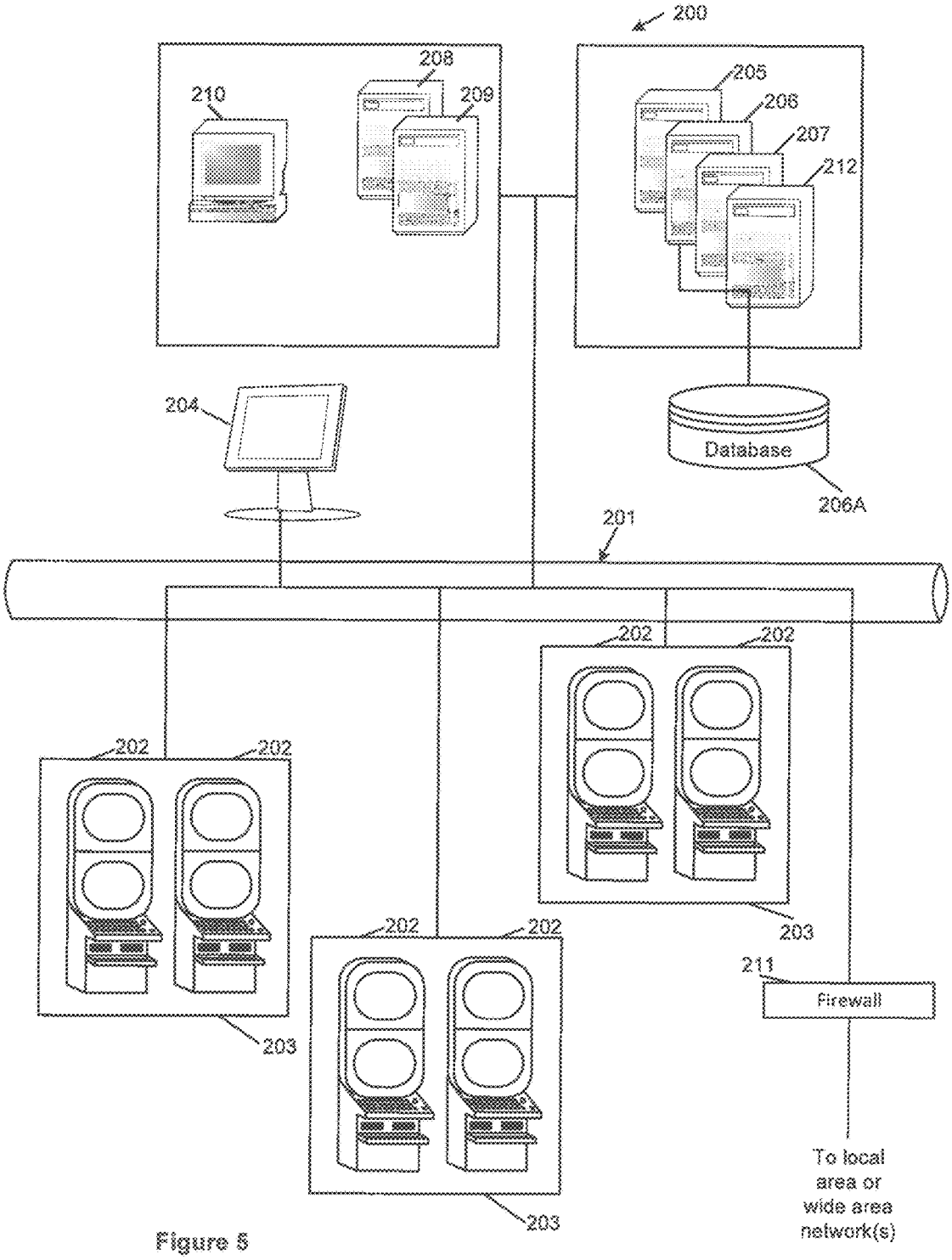
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

In order to participate in the game, the player operates the game play mechanism 56 to specify a wager and hence win entitlements which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of pay lines and are an inherent part of the win entitlement.

Persons skilled in the art will appreciate that in other embodiments, the player may obtain a win entitlement by selecting a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. The total number of ways to win is determined by multiplying the number of active display positions of each reels, the active display positions being all display positions of each selected reel and the designated display position of the non-selected reels. As a result for five reels and fifteen display positions there are 243 ways to win.

In other embodiments a player win entitlement may be affected by purchasing access to particular pay tables—e.g. a first bet amount entitles the player to wins including cherry symbols and a second amount entitles them to wins including plum symbols.

Figure 6:
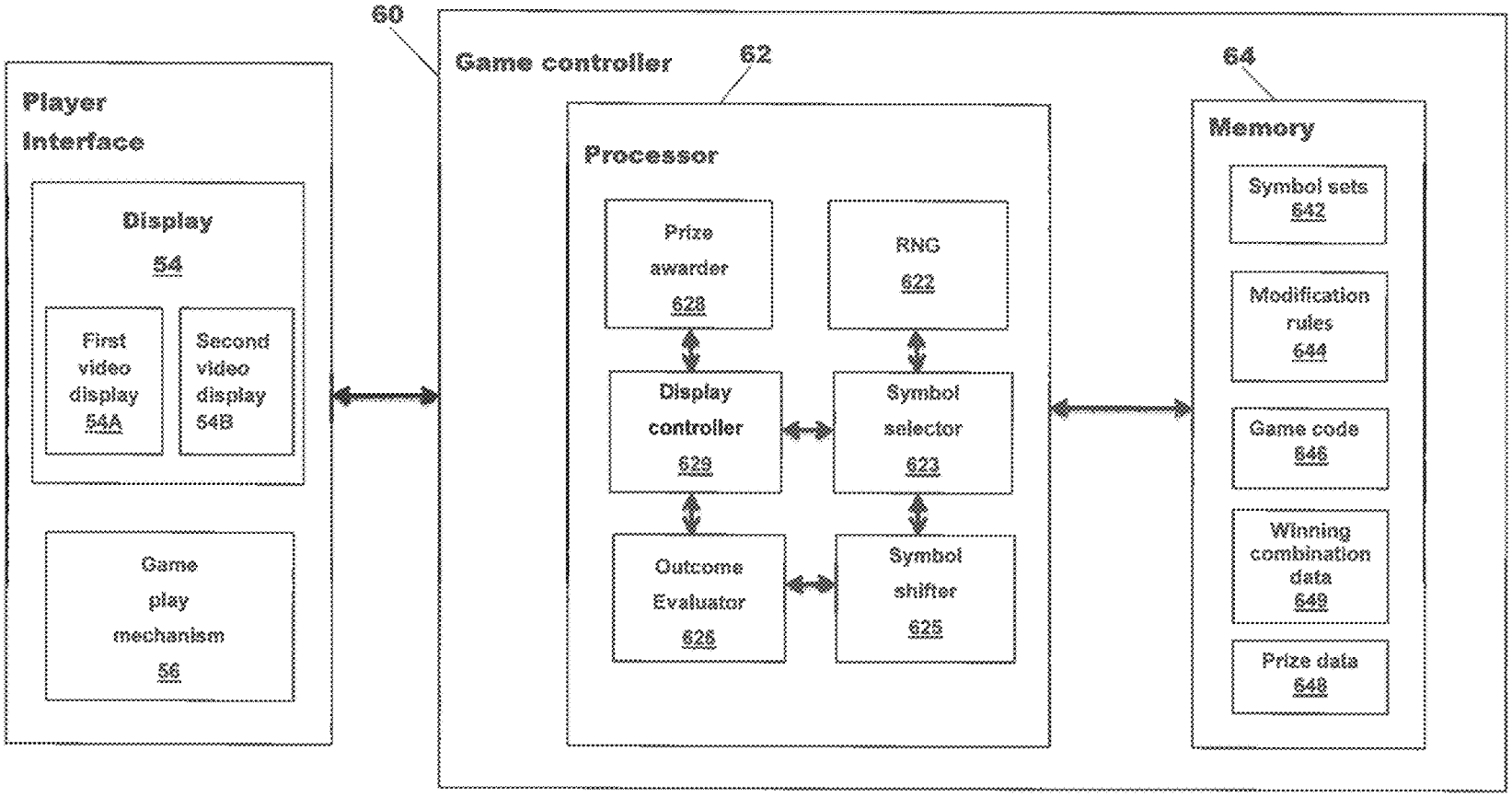
FIG. 6 is a further block diagram of a gaming system.

In FIG. 6, the processor 62 of the game controller 60 is shown implementing a number of modules based on program code and data stored in memory 64. These modules include a symbol selector 623, a symbol mover 625, a symbol evaluator (or outcome evaluator) 626 and a prize awarder 628. Persons skilled in the art will appreciate that one or more of the modules could be implemented in some other way, for example by a dedicated circuit.

As indicated above, depending on the embodiment, the game controller 60 may be arranged to select a plurality of symbols for display on video displays 54, for a sequence of game instances.

In the embodiment where symbols are selected for display at each video display 54, the symbol selector 623 operates in response to a player's operation of the game play mechanism 56 to place a wager and initiate a play of a game. In this embodiment, there are multiple display areas arranged on the two symbol displays 54A and 54B, and the symbol selector 623 initiates play of a game by selecting, independently for each of the display areas of the symbol display provided by the displays 54A and 54B, a set or plurality of symbols for display at respective symbol display positions on the video displays 54. When in use, the symbol selector 623 selects the symbols for display based on random numbers (or pseudo-random numbers) generated by a random number generator (RNG) 622 implemented by the processor 62 and symbols sets 642 stored in the memory 64 of the game controller 60, and a display controller 629 implemented by the processor 62 which controls the two displays 54A and 54B to display the selected symbols on each of the display areas of the video displays 54. The display areas are provided on two video displays 54A and 54B, the processor 62 may implement separate display controllers for controlling the separate displays. However, as indicated above, it is envisaged that the display areas of the symbol display may alternatively be provided on a single video display in an alternative embodiment. Also, it is envisaged that, in an alternative embodiment, the display areas of the symbol display may alternatively be on the respective displays of separate gaming machines comprising separate game controllers comprising separate processors implementing separate display controllers, and separate games may be played at the separate gaming machines.

In the embodiment described, there are two display areas provided on two separate video displays 54A, 54B. In a first implementation of the game, the same amount of symbol display positions may be arranged on the first and the second video displays 54A and 54B. In a second implementation of the game, more symbol display positions may be arranged in a first video display 54A when compared to the second video display 54B.

For each instance of the game, a subset of the symbols displayed in the symbol display positions is evaluated by the outcome evaluator 626 to determine whether to make an award. The outcome evaluator 626 communicates with the winning combination data 649 stored in memory 64.

The symbol selector 623 selects symbols from a symbol set and assigns the selected symbols to a plurality of respective symbol display positions on the first and the second video displays 54A and 54B. The symbols in each symbol display position may be changed by the symbol selector 623 for each instance of the game. The symbols in each column of the gaming area may be arranged in a reel configuration and the reel may be spun at each instance of the game changing the symbol in the symbol display positions positioned in that column of the gaming area.

During each instance of the game the outcome evaluator 626 evaluates a subset of the symbols on the gaming area to determine whether to instruct the prize awarder 928 to make an award. Processor 62 controls the outcome evaluator 626 to evaluate a variable subset of symbols at each game instance. The number of symbols in the symbol subset evaluated by the outcome evaluator 626 increases for each game instance. The number of winning lines which can generate an award increase with the increasing number of symbols. Processor 62 controls the outcome evaluator 626 and the two video displays 54A and 54B in a manner such that, during the first instance of the game, the one or more symbols of the symbol subset which are evaluated by the outcome evaluator 626 are positioned in symbol display positions on the first video display 54A. The second video display 54B is positioned on top of the first video display 54A and displays symbols in respective symbol display positions which are not part of the symbol subset and are not evaluated by the outcome evaluator 626. During the game, symbols are added to the symbol subset for each instance and, during the last instance of the game, all the symbols displayed in the second video display 54B are part of the symbol subset and are evaluated by the outcome evaluator 626. The symbols comprised in the symbol subset which are evaluated by the outcome evaluator 626 have a different graphical appearance which differentiates them from the symbols which are not evaluated. For example, the symbols which are not evaluated may look like frozen symbols. These symbols may become unfrozen as they are added to the symbol subset.

The symbol selector 623 selects a movable symbol which may take one or more symbols positions on the gaming area. For each game instance, symbol mover 625 moves the movable symbol upwards in the gaming area to swap its positions with other symbols on the gaming area. While the movable symbol is being moved by the symbol mover 625, the processor 62 adds one or more symbols to the symbol subset and communicates with the prize awarder 628 to increase an award multiplier. The movable symbol may be a wild symbol.

When the symbols of the symbol subset are evaluated by the outcome evaluator 626, the prize awarder 628 may make one or more awards based on the prize data 648 stored in the memory 64 if winning symbol combinations are identified in accordance with winning combinations data 649.

In a second embodiment, not all the symbol display positions are positioned on the display area of the video displays 54A and 54B. In a manner similar to the addition of symbols to the symbol subset which is evaluated by the outcome evaluator 626, new symbol display positions are added to the display area for each game instance. For example during the first game instance only the first video display 54A may comprise symbol display positions, while the second video display may show an animation or a picture. While the game is played, for each instance of the game symbol display positions may be added and may be displayed on the second video display 54B. In this embodiment the subset of symbols may comprise all the symbols in all the display positions for each instance of the game. In this case the subset of symbols is increased at each instance by increasing the number of symbol display positions. The symbol subset may also comprise some of the symbols displayed at the symbol display positions, and some other is the symbols may not be part for the subset and be displayed, for example, as frozen symbols.

Figure 7:
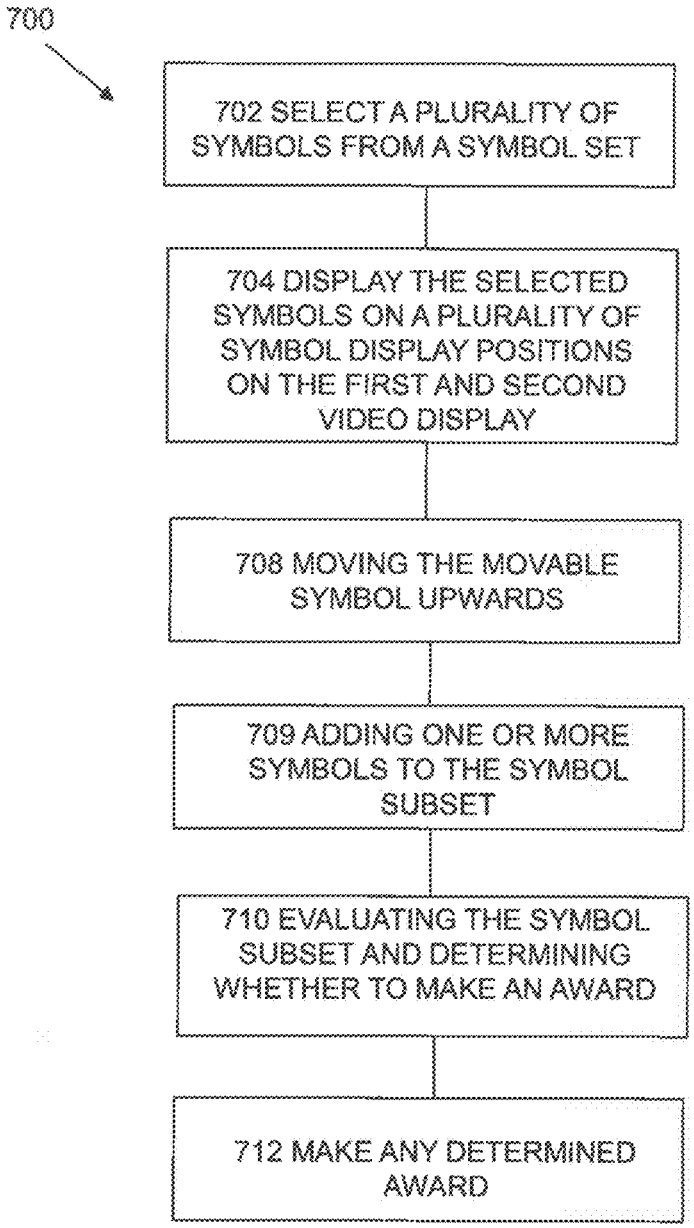
FIG. 7 is a flow chart of an embodiment.

In FIG. 7, there is shown a flowchart 700 of a method of gaming in respect of the first embodiment. The beginning of the game may be triggered by several events, for example a player places a wager and initiates a play of the game, or a player is playing a an initial game and a particular condition which takes place in the initial game triggers a feature game which may be the game of the first embodiment. Types of feature games include: those where a series of free game events are awarded such as free games or re-spins (where some reels are held while others are re-spun); games where the symbols on the reel are changed; and "second screen" games where game play is totally different to the base game, for example where the player makes selections in a "pick a box type" game.

At step 702, the symbol selector 623 selects a plurality of symbols from a symbol set. At step 704 the processor 62 controls the first video display 54A and the second video display 54B to display the plurality of symbols at respective display positions. At step 708 the symbol mover module 625 moves the movable symbol upwards on the gaming area. At step 709 the processor 62 adds one or more symbols to the symbol subset and, at step 710 the outcome evaluator 626 evaluates the symbol subset and determines whether to make an award. At this stage the processor 62 may increase a prize multiplier. At step 712 the prize awarder 628 makes one or more awards based on the prize data 648 stored in the memory 64 if winning symbol combinations are identified in accordance with winning combinations data 649. For each game instance some or all of the steps of flow chart 700 are performed.

Figure 8A:
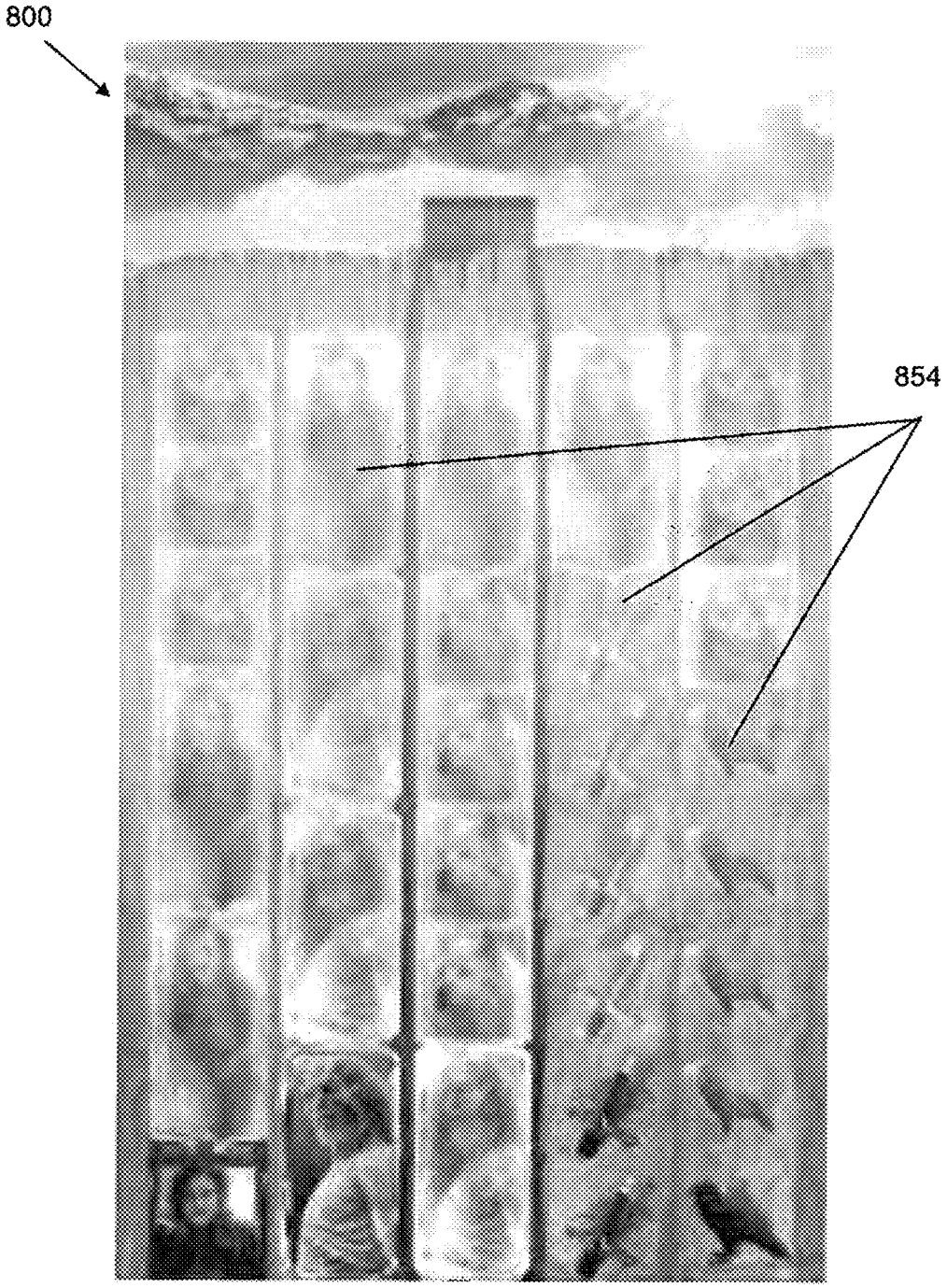
FIGS. 8A and 8B are screen shots of a first video display and a second video display of a gaming area in accordance with an embodiment.
Figure 8B:
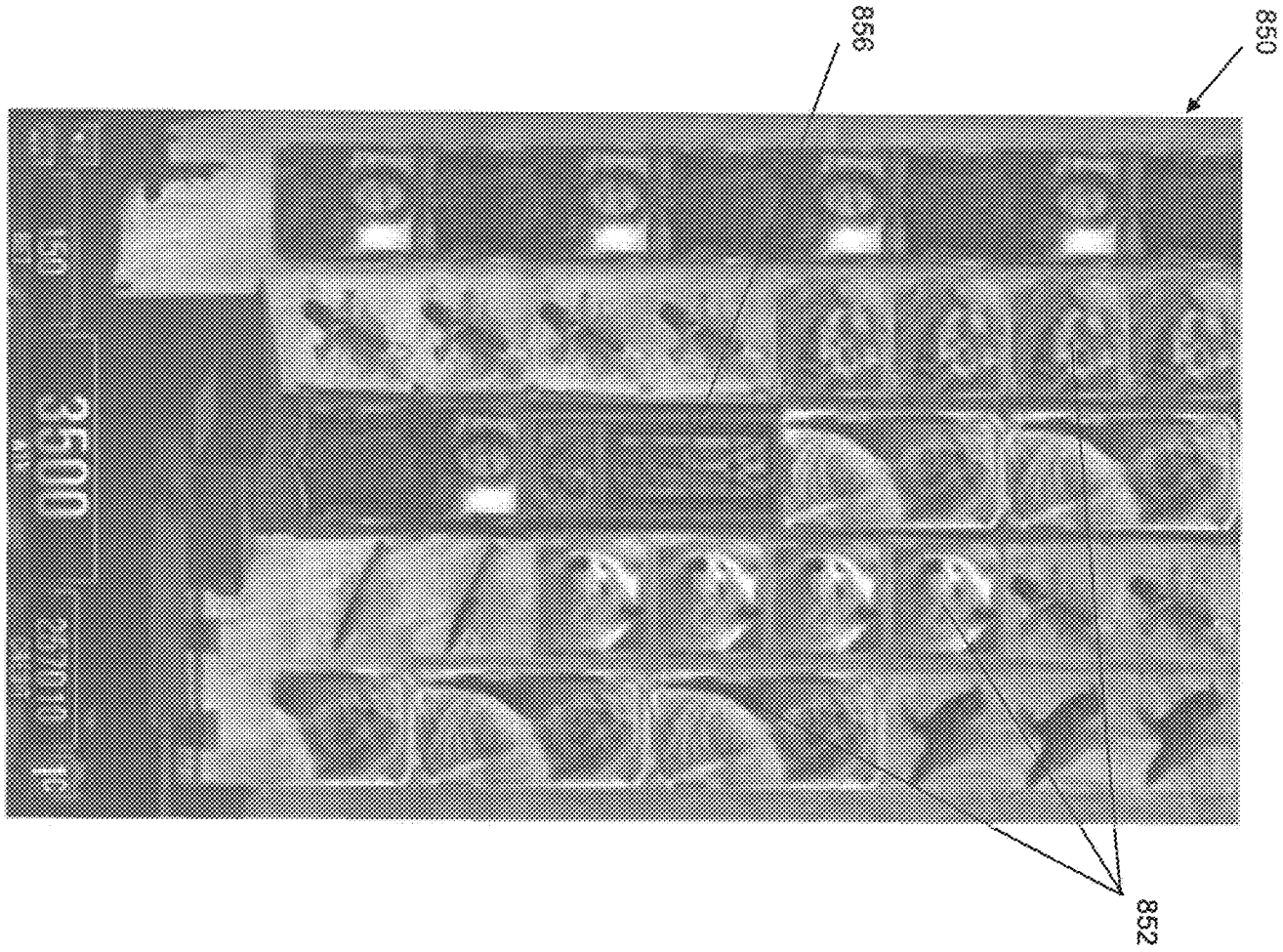

Referring now to FIGS. 8A and 8B, there are shown screen shots 800 and 850 of a first and a second video display of a gaming area in accordance with the first embodiment. Screen shot 800 is a screen shot of (top) display 54B, in accordance with the first embodiment and screen shot 850 is a screen shot of (bottom) display 54A, in accordance with the first embodiment.

The gaming area shown in the first and second video displays replicates an ice wall which is a landmark of motion picture series "Game of Thrones". The symbols available to the symbol selector 623 represent characters of the same series 852. Screen shots 800 and 850 show a possible configuration of the symbols positioned on the first and the second video display 54A and 54B during a game. The majority of the symbols of the symbol subset evaluated by the symbol evaluator 626 are displayed in symbols display positions on the first video display 54A in clear colours, 852. The remaining symbols, which are not part of the symbol subset and are not evaluated by the symbol evaluator 626, are displayed in symbols display positions on the second video display 54B and appear as frozen symbols, 854. The movable symbol is provided in the form of an elevator 856. For each game instance, elevator 856 moves upwards along the ice and ice falls away from the frozen symbols above the elevator 856. As the ice falls from these symbols, these symbols are added to the symbol subset increasing the number of paylines and the possible winning combinations available to the player.

The movable symbol 856 is also a wild symbol. In particular, the elevator 856 is a two symbol display positions high wild symbol and carries an award multiplier which is incremented each time the elevator 856 is moved up along the ice wall.

Symbols positioned on symbol display positions on the same columns of the gaming area belong to symbol reels. The gaming area has 5 reels. At the beginning of the game each reel may only have one symbol 'unfrozen' which is part of the evaluated symbol subset. During the last instance of the game, the elevator 856 reaches the top of the wall and all the symbols are ice free and part of the symbol subset. When the reels are spun in this last instance the reels are expanded to a 16×5 matrix of symbols display positions with symbols evaluated by the symbol evaluator 626. This provides the player with 134 available lines.

To be awarded a prize, during one of the game instances the reels are spun and a given combination of symbols of the symbol subset must be obtained along an available winning line. The symbol evaluator 626 implemented by the processor 62 of the game controller 60 of the gaming machine then evaluates the symbol subset and the prize in accordance with winning combinations data 649 and the prize awarder 628 awards a prize in accordance with prize data 648.

In the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electronic gaming system comprising:

a credit input mechanism configured to receive a credit input in the form of a physical item representing a monetary value for establishing a credit balance, the credit balance being increasable and decreasable based at least on wagering activity;

credit meters configured to monitor the credit balance;

a video display configured to have a plurality of symbol display positions;

a memory configured to store a symbol set comprising a number of symbols including a movable symbol;

a game controller configured to:

for a first game instance, select a plurality of symbols from the symbol set;

display on the video display the movable symbol or one of the plurality of symbols selected at each one of the respective plurality of symbol display positions such that each of the plurality of symbol display positions includes at least one of the movable symbol or the plurality of symbols selected, wherein the movable symbol is located at a first symbol display position in the plurality of symbol display positions; and evaluate plurality of symbols selected in a first subset of the plurality of symbol display positions to determine whether to make a first award, wherein the first subset includes a first number of the plurality of symbol display positions; and for a second game instance, move the movable symbol visually on the video display from the first symbol display position in the first subset of the plurality of symbol display positions to a second symbol display position disposed outside of the first subset of the plurality of symbol display positions;

expand the first subset of the plurality of symbol display positions into a second subset of the plurality of symbol display positions having a second number of the plurality of symbol display positions, wherein the second subset includes the second symbol display position and wherein the first subset of the plurality of symbol display positions and the second number of the plurality of symbol display positions is greater than the first number of the plurality of symbol display positions; and evaluate the plurality of symbols selected in the second subset of the plurality of symbol display positions in the second game instance to determine whether to make a second award.

2. The electronic gaming system of claim 1, wherein the video display comprises a first video display and second video display, wherein the second video display is positioned above the first video display.

3. The electronic gaming system of claim 1, wherein the movable symbol is a WILD symbol.

4. An electronic gaming system comprising:

a credit input mechanism configured to receive a credit input in the form of a physical item representing a monetary value for establishing a credit balance, the credit balance being increasable and decreasable based at least on wagering activity;

credit meters configured to monitor the credit balance;

a video display configured to have a plurality of symbol display positions;

a memory configured to store a symbol set comprising a number of symbols and a movable symbol;

a game controller configured to:

for a first game instance, (i) select a plurality of symbols from among the number of symbols and the movable symbol of the symbol set;

(ii) display on the video display the movable symbol or one of the plurality of symbols selected at each one of the respective plurality of symbol display positions such that each of the plurality of symbol display positions includes at least one of the movable symbol or the plurality of symbols selected, wherein the movable symbol is located at a first symbol display position in the plurality of symbol display positions (iii) evaluate the plurality of symbols selected in a first subset of the plurality of symbol display positions to determine whether to make a first award, wherein the first subset includes a first number of the plurality of symbol display positions; and for a second game instance, (i) move the movable symbol visually on the video display from the first subset of the plurality of symbol display positions to a second subset of the plurality of symbol display positions, wherein the second subset of the plurality of symbol display positions having a second number of the plurality of symbol display positions that includes the first subset of the plurality of symbol display positions and wherein the second number of the plurality of symbol display positions is greater than the first number of the plurality of symbol display positions;

(ii) expand the first subset of the plurality of symbol display positions into the second subset of the plurality of symbol display positions; and (iii) evaluate the plurality of symbols selected in the second subset of the plurality of symbol display positions in the second game instance to determine whether to make a second award.

5. The electronic gaming system of claim 4, wherein the video display includes a first video display and a second video display, the second video display being positioned above the first video display.

6. The electronic gaming system of claim 4, wherein the game controller is configured to move the movable symbol upwardly on the video display.

7. The electronic gaming system of claim 4, wherein the movable symbol is visually moved to a second symbol display position that is located above the first symbol display position.

8. The electronic gaming system of claim 4, wherein the game controller is configured to move the movable symbol vertically upwardly on the video display.

9. The electronic gaming system of claim 4, wherein the game controller is configured to move the movable symbol to a second display position replacing a symbol in the second display position.

10. The electronic gaming system of claim 4, wherein the movable symbol swaps display positions with a symbol in the second symbol display position.

11. The electronic gaming system of claim 4, wherein the movable symbol is a WILD symbol.

12. The electronic gaming system of claim 4, wherein the movable symbol is an animated symbol.

13. The electronic gaming system of claim 4, wherein the movable symbol occupies two of the plurality of symbol display positions.

14. The electronic gaming system of claim 4, wherein the movable symbol is provided in the form of an elevator.

15. The electronic gaming system of claim 4, wherein the movable symbol carries an award multiplier.

16. The electronic gaming system of claim 15, wherein the award multiplier carried by the movable symbol is incremented each time the movable symbol is moved.

17. The electronic gaming system of claim 4, wherein a second symbol display position displays a symbol, and wherein the movable symbol moves upwardly from the first display position to the second symbol display position, and the symbol in the second symbol display position visually changes so as to identify itself as now being a symbol in the expanded first subset of symbol display positions.

18. The electronic gaming system of claim 4, wherein the symbols of the first subset of the plurality of symbol display positions are displayed having a different graphical appearance than the plurality of symbols selected outside of the first subset of the plurality of symbol display positions so as to differentiate the symbols in the first subset of the plurality of symbol display positions.

19. The electronic gaming system of claim 18, wherein the plurality of symbols selected outside of the first subset of the plurality of symbol display positions appear to be frozen symbols.

20. The electronic gaming system of claim 4, wherein the plurality of symbol display positions are arranged in five columns on the video display.

21. The electronic gaming system according to claim 20 wherein additional symbol display positions are added during play.

22. The electronic gaming system according to claim 4 wherein new symbol display positions are added to the video display for a subsequent game instance.

23. The electronic gaming system of claim 4, wherein the plurality of symbols selected are selected randomly.

24. The electronic gaming system according to claim 4, wherein a plurality of additional game instances are played, and wherein, in each additional game instance an additional subset of symbol display positions are evaluated having a different number of the plurality of symbol display positions that includes a previous subset of the plurality of symbol display positions; and wherein the different number of the plurality of symbol display positions in the additional subset to be evaluated increases for each additional game instance.

25. The electronic gaming system of claim 4, wherein the plurality of symbols in the first subset of the plurality of symbol display positions are evaluated in accordance with paylines.

* * * * *